US008768233B2

(12) United States Patent
Nakane et al.

(10) Patent No.: US 8,768,233 B2
(45) Date of Patent: Jul. 1, 2014

(54) SOLID LUBRICANT-COATING DEVICE AND IMAGE-FORMING APPARATUS

(75) Inventors: Yoshiki Nakane, Toyokawa (JP); Kuniaki Kashiwakura, Toyohashi (JP); Ikuko Kanazawa, Hino (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 782 days.

(21) Appl. No.: 12/967,429

(22) Filed: Dec. 14, 2010

(65) Prior Publication Data

US 2011/0143024 A1 Jun. 16, 2011

(30) Foreign Application Priority Data

Dec. 16, 2009 (JP) ..... 2009-285136

(51) Int. Cl.
*G03G 21/00* (2006.01)

(52) U.S. Cl.
USPC ..... 399/346

(58) Field of Classification Search
USPC ..... 399/346; 430/126.3, 126.2
See application file for complete search history.

(56) References Cited

U.S. PATENT DOCUMENTS 7,209,699 B2 * 4/2007 Yamaguchi et al. ..... 399/346
7,496,324 B2 2/2009 Sugiura et al.
7,505,728 B2 * 3/2009 Yamaguchi et al. ..... 399/346
7,593,682 B2 9/2009 Tokumasu et al.
7,616,922 B2 * 11/2009 Yoshino et al. ..... 399/346
7,899,383 B2 3/2011 Shintani et al.
2005/0191099 A1 9/2005 Yamaguchi et al.
2006/0210334 A1 9/2006 Tokumasu et al.
2007/0183824 A1 * 8/2007 Suda et al. ..... 399/346

(Continued)

FOREIGN PATENT DOCUMENTS

JP 61-239279 A 10/1986
JP 2005-241966 A 9/2005

(Continued)

OTHER PUBLICATIONS

European Search Report dated Mar. 24, 2011, issued in the corresponding European Patent Application No. 10194898.2-2209.

(Continued)

*Primary Examiner* — Sandra Brase
(74) *Attorney, Agent, or Firm* — Buchanan Ingersoll & Rooney PC

(57) ABSTRACT

A solid lubricant-coating device is provided with a solid lubricant to be applied to the surface of a latent image-supporting member; a supply roller for scraping and supplying the solid lubricant onto the surface of the latent image-supporting member by self rotation; a pressing unit for pressing the solid lubricant onto the supply roller; a flattening unit for forming a thin film of the supplied solid lubricant on the surface of the latent image-supporting member; and a cleaning unit for removing the residual toner on the surface of the latent image-supporting member and recovering the solid lubricant thin film on the surface of the latent image-supporting member, wherein, when a thickness of the solid lubricant thin film immediately before the supply roller in the rotation direction of the latent image-supporting member is designated as thickness A (nm) and a thickness immediately after the flattening unit is designated as thickness B (nm), the thicknesses A and B satisfy the following relational formulae (1) and (2): $B-A \geq 8$ (1) and $A \geq 4$ (2).

14 Claims, 3 Drawing Sheets

(56) References Cited

U.S. PATENT DOCUMENTS

| | | | | |
|---|---|---|---|---|
| 2008/0138727 | A1 | 6/2008 | Fukushima et al. | |
| 2008/0170897 | A1* | 7/2008 | Harada | 399/346 |
| 2009/0010692 | A1* | 1/2009 | Hozumi et al. | 399/346 |
| 2009/0103944 | A1* | 4/2009 | Shintani et al. | 399/346 X |

FOREIGN PATENT DOCUMENTS

| | | | |
|---|---|---|---|
| JP | 2006-259031 | A | 9/2006 |
| JP | 2006-259661 | A | 9/2006 |
| JP | 2008-033067 | A | 2/2008 |
| JP | 2008-165156 | A | 7/2008 |
| JP | 2008-275724 | A | 11/2008 |
| JP | 2009-098555 | A | 5/2009 |

OTHER PUBLICATIONS

Office Action dated Nov. 8, 2011, issued in the corresponding Japanese Patent Application No. 2009-285136, and an English Translation thereof.

* cited by examiner

Prior Art

SOLID LUBRICANT-COATING DEVICE AND IMAGE-FORMING APPARATUS

This application is based on application No. 2009-285136 filed in Japan, the contents of which are hereby incorporated by reference.

BACKGROUND OF THE INVENTION

1. Field of the Invention

The present invention relates to a solid lubricant-coating device and an image-forming apparatus.

2. Description of the Related Art

There exist a demand for acceleration of image-forming in common image-forming apparatuses using the electrophotographic mode, such as copying machines, printers and facsimile apparatuses. It is needed, for acceleration of image-forming, to increase the output of the charging unit for charging the surface of photosensitive member and the sensitivity of the photosensitive member. However, increase in output of the charging unit leads to increase in the amounts of $O_3$ and $NO_x$ emitted, and increase in sensitivity of the photosensitive member leads to easier change of the properties of the photosensitive member surface by $O_3$ and $NO_x$, causing a problem of generation of image noises such as image blurring and image flowing. It may be possible to prevent generation of the imaging noises by abrading the photosensitive member surface altered in properties, but such a method also caused a problem that the lifetime of the photosensitive member was shortened.

Disclosed is a technology concerning an image-forming apparatus, comprising an application unit for applying a solid lubricant to the surface of a photosensitive member, a flattening unit for making a thin film of the applied solid lubricant at a downstream position of the application unit, and a lubricant-removing unit for removing the deteriorated solid lubricant at an upstream position of the application unit (Japanese Patent-Application Laid-Open No. 2006-259031). If such a technology is used, the lifetime of the photosensitive member may be elongated, but the problem of image noises could not be prevented sufficiently.

An object of the present invention is to provide a solid lubricant-coating device and an image-forming apparatus that can prevent generation of image noises such as image blurring and image flowing sufficiently, even when image-forming is carried out at high speed.

BRIEF SUMMARY OF THE INVENTION

The present invention relates a solid lubricant-coating device, comprising:

a solid lubricant to be applied to the surface of a latent image-supporting member;

a supply roller installed in contact with the solid lubricant and the latent image-supporting member that scrapes off the solid lubricant and supplies the scraped solid lubricant onto the surface of the latent image-supporting member by self rotation;

a pressing unit for pressing the solid lubricant to the supply roller;

a flattening unit installed in contact with the latent image-supporting member at a downstream position of the supply roller in the rotation direction of the latent image-supporting member that forms a thin film of the supplied solid lubricant on the latent image-supporting member surface; and a cleaning unit installed in contact with the latent image-supporting member at an upstream position of the supply roller in the rotation direction of the latent image-supporting member that removes the residual toner on the latent image-supporting member surface and recovers the solid lubricant thin film on the latent image-supporting member surface, wherein when a thickness of the solid lubricant thin film formed on the latent image-supporting member surface immediately before the supply roller in the rotation direction of the latent image-supporting member is designated as thickness A (nm) and a thickness immediately after the flattening unit is designated as thickness B (nm), the thicknesses A and B satisfy the following relational formulae (1) and (2):

$$B-A \geq 8 \quad (1) \text{ and}$$

$$A \geq 4 \quad (2).$$

The present invention also relates to an image-forming apparatus, comprising the solid lubricant-coating device.

DETAILED DESCRIPTION OF THE INVENTION

Image-Forming Apparatus

The image-forming apparatus according to the present invention has a particular coating device for application of a solid lubricant to a latent image-supporting member. The latent image-supporting member is a photosensitive member such as so-called photosensitive drum and photosensitive belt. Hereinafter, favorable embodiments of the invention wherein a solid lubricant is applied to a photosensitive drum will be described, but it is obvious that the advantageous effects by the present invention can also be obtained, even when the solid lubricant is applied to a photosensitive belt.

Figure 1:
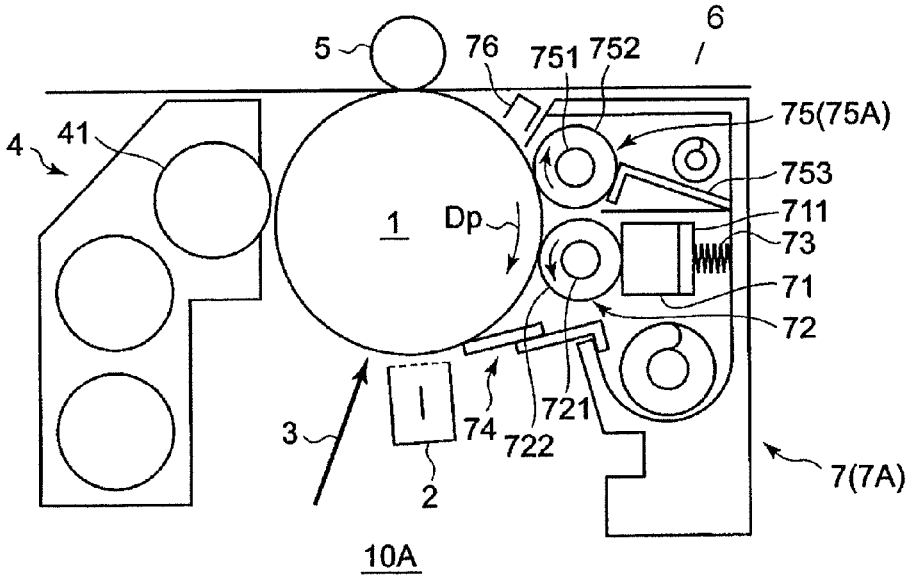
FIG. 1 is a schematic configurational view illustrating a first embodiment of the image-forming apparatus according to the present invention.
Figure 2:
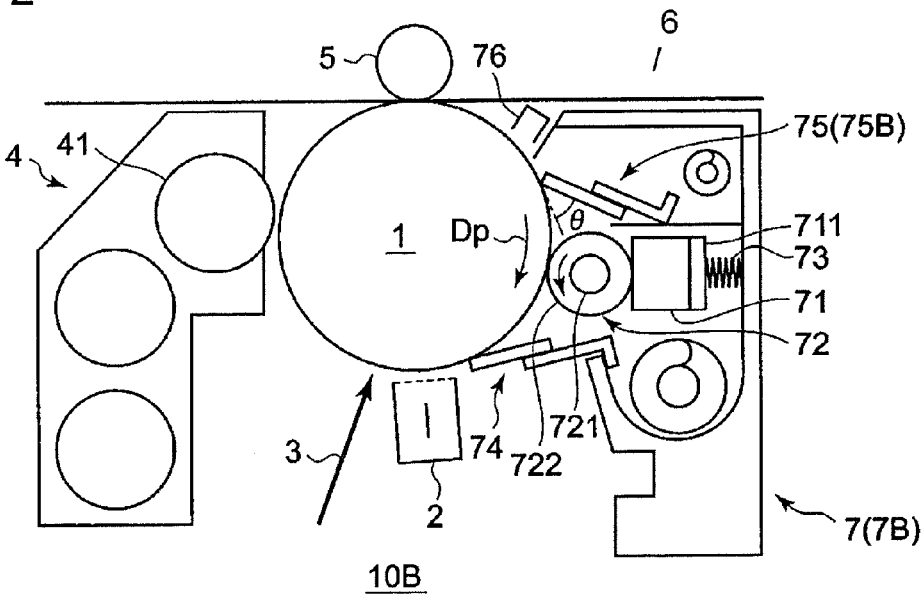
FIG. 2 is a schematic configurational view illustrating a second embodiment of the image-forming apparatus according to the present invention.

The image-forming apparatus according to the present invention will be described in detail, with reference to FIGS. 1 and 2 showing the first and second embodiments of the image-forming apparatus according to the present invention. FIG. 1 is a schematic view illustrating the configuration of a first embodiment of the image-forming apparatus according to the present invention. FIG. 2 is a schematic view illustrating the configuration of a second embodiment of the image-forming apparatus according to the present invention. The image-forming apparatus 10B and the solid lubricant-coating device 7B shown in FIG. 2 are similar to the image-forming apparatus 10A and the solid lubricant-coating device 7A shown in FIG. 1, except that the cleaning unit 75 is changed from the cleaning roller 75A to the cleaning blade 75B. Hereinafter, the reference numerals in FIG. 2 identical with those in FIG. 1 indicate the same members or the same meanings. The image-forming apparatus 10 includes the image-forming apparatus 10A shown in FIG. 1 and the image-forming apparatus 10B shown in FIG. 2. The solid lubricant-coating device 7 includes the solid lubricant-coating device 7A shown in FIG. 1 and the solid lubricant-coating device 7B shown in FIG. 2. The cleaning unit 75 includes cleaning roller 75A and cleaning blade 75B.

The image-forming apparatus 10 according to the present invention is an apparatus having a coating device 7 for application of a solid lubricant to a photosensitive member and normally having additionally at least a rotary cylindrical photosensitive member 1, a charging unit 2 for electrically charging the surface of the photosensitive member uniformly, an exposing unit 3 for forming an electrostatic latent image on the photosensitive member by exposure, a developing device 4 for developing a toner image on the basis of the electrostatic latent image, and a transfer unit 5 for transferring the toner image formed on the photosensitive member onto an image-receiving member 6. Any known electrophotographic technology may be used arbitrarily for the photosensitive member 1, the charging unit 2, the exposing unit 3, the developing device 4, the transfer unit 5 and others used in the image-forming apparatus 10.

In particular, the photosensitive layer of the photosensitive member 1 may be made of an organic or inorganic material, but a photosensitive layer of organic material is preferable. The photosensitive layer is preferably a laminated photosensitive layer having a charge generation layer and a charge transport layer, and it is more preferable that an overcoat layer (OCL) having a thickness of about 1 to 6 μm is additionally formed on the outmost surface thereof. The overcoat layer preferably contains inorganic fine particles having an average primary particle diameter of 20 to 50 nm dispersed therein. The particles provide the surface with hubbly roughness, improving incorporation and retention properties of the solid lubricant. Examples of the inorganic fine particles include silica, alumina, titania and the like.

The peripheral velocity Vp of the photosensitive member 1 is not particularly limited, but it is preferably relatively higher velocity, such as 0.25 to 0.8 m/sec, in particular 0.3 to 0.6 m/sec. Image-forming, as the photosensitive member is rotated at such a high speed, demands increase in output of the charging unit and sensitivity of the photosensitive member, leading to generation of image noises such as image blurring and image flowing, but according to the present invention, the generation of image noises are prevented sufficiently, even if image-forming is carried out at such a high speed.

The charging unit 2 is not particularly limited. Typical examples of the charging unit include Scorotron chargers, charging brushes, charging rollers and the like, and, as shown in FIGS. 1 and 2, use of a Scorotron charger, which is not in contact with the photosensitive member surface, is advantageous from the viewpoint of uniformity of electrically charging.

Solid Lubricant-Coating Device

Hereinafter, the solid lubricant-coating device 7 will be described in detail.

The coating device 7 has a solid lubricant 71 to be applied to a photosensitive member surface;

a supply roller 72 placed in contact with the solid lubricant and the photosensitive member 1 that scrapes off the solid lubricant and supplies the scraped solid lubricant to the photosensitive member surface by self rotation;

a pressing unit 73 for pressing the solid lubricant onto the supply roller;

a flattening unit 74 placed at a downstream position of the supply roller in the rotation direction Dp of the photosensitive member in contact with the photosensitive member 1 that forms a thin film of the solid lubricant supplied to the photosensitive member surface; and a cleaning unit 75 placed at an upstream position of the supply roller in the rotation direction Dp of the photosensitive member in contact with the photosensitive member 1 that removes the residual toner on the photosensitive member surface and recovers the thin film of the solid lubricant formed on the photosensitive member surface.

The coating device 7 scrapes off the solid lubricant 71 pressed to the supply roller 72 by the pressing unit 73 and supplies the scraped solid lubricant onto the surface of the photosensitive member 1 by means of the supply roller 72, and forms a thin film of the supplied solid lubricant on the surface of the photosensitive member 1 with the flattening unit 74. On the surface of the photosensitive member 1 on which the solid lubricant thin film has been formed, a charge by the charging unit 2, an exposure by the exposing unit 3, a development by the developing device 4 and a transfer by the transfer unit 5 are carried out, and finally, the toner remaining on the photosensitive member surface is removed and the thin film of the solid lubricant is recovered from the photosensitive member surface by the cleaning unit 75 of the coating device 7.

With respect to a thickness of the solid lubricant thin film formed on the photosensitive member surface during such coating-recovering processes of the solid lubricant, when a thickness immediately before the supply roller 72 in the photosensitive member rotation direction Dp is designated as A (nm) and a thickness immediately after the flattening unit 74 is designated as B (nm), the thicknesses A and B satisfy the following relational formulae (1) and (2):

$$B-A\geq 8 \quad (1) \text{ and}$$

$$A\geq 4 \quad (2),$$

particularly preferably the following relational formulae (1') and (2'):

$$50\geq B-A\geq 8 \quad (1') \text{ and}$$

$$30\geq A\geq 4 \quad (2').$$

For further sufficient prevention of generation of image noises such as image blurring and image flowing, the thicknesses A and B more preferably satisfy the following relational formulae (1") and (2");

$$30\geq B-A\geq 8 \quad (1'') \text{ and}$$

$$10\geq A\geq 4 \quad (2'').$$

The relational formulae (1), (1') and (1") specify B−A, i.e., the thickness removed by the cleaning unit 75. The relational formulae (2), (2') and (2") specify A, i.e., the thickness after recovery of the solid lubricant and before supply thereof. It is possible, by controlling the thicknesses thereof respectively in the ranges above, to form a solid lubricant thin film having a thickness of B stably at a position immediately after the flattening unit 74 and to recover the deteriorated surface layer region of the solid lubricant thin film effectively. As a result, the solid lubricant on the photosensitive member surface is replaced smoothly, and it is thus possible to prevent generation of image noises such as image blurring and image flowing sufficiently, even if image-forming is carried out at high speed. When B−A is too small, the solid lubricant is recovered or removed only slightly, leaving the deteriorated solid lubricant on the photosensitive member surface. As a result, $O_3$ and $NO_x$ contained in the deteriorated solid lubricant penetrate to the surface of the photosensitive member under the thin film, causing degradation of the photosensitive layer and consequently generating image noises such as image blurring and image flowing. If A is too small, even when the solid lubricant is supplied to and coated on the thin film, the thin film is not formed smoothly by the flattening unit, giving a thin film having an uneven thickness of B. For that reason, the deteriorated solid lubricant is not recovered or removed sufficiently by the cleaning unit, and $O_3$ and $NO_x$ contained in the deteriorated solid lubricant penetrate to the surface of the photosensitive member under the thin film, leading to degradation of the photosensitive layer and consequently, to generation of image noises such as image blurring and image flowing.

The relational formulae are to be satisfied during the period from when an unused (new) photosensitive member is installed in the image-forming apparatus 10 to just after 1000 sheets of A4 paper are fed into it without image-forming at an ambient temperature of 10° C. and a humidity of 15%, but the relational formulae are normally satisfied always after an unused photosensitive member is installed and approximately 50 sheets or more of A4 paper are fed into it, independently of whether image-forming was carried out or not thereafter.

The thickness A at a position immediately before the supply roller 72 in the photosensitive member rotation direction Dp is the thickness of the solid lubricant thin film in the region of the photosensitive member surface upstream of the supply roller 72 and downstream of the cleaning unit 75 in the same direction Dp.

The thickness A used in the present specification, is a value on a line upstream by 5 mm (measurement line) from the boundary line upstream in the contacting region of the photosensitive member surface with the supply roller in the photosensitive member rotation direction Dp.

The thickness B at a position immediately after the flattening unit 74 in the photosensitive member rotation direction Dp is the thickness of the solid lubricant thin film in the region of the photosensitive member surface downstream of the flattening unit 74 and upstream of the developing device 4 in the same direction Dp.

The thickness B used in the present specification is a value on a line downstream by 5 mm (measurement line) from the boundary line downstream in the contacting region of the photosensitive member surface with the flattening unit 74 in the photosensitive member rotation direction Dp.

The thickness of the solid lubricant thin film formed on the photosensitive member surface can be determined by determining the afore-described measurement line on the photosensitive member surface, removing the photosensitive member from the image-forming apparatus, and determining the thickness by XPS depth profile measurement. For example, when a fatty acid metal salt is used as the solid lubricant, distribution of the metal constituting the salt in the depth direction is determined as the distribution of the fatty acid metal salt and the thickness of the solid lubricant thin film on the measurement line is determined. Specifically, the thickness of the solid lubricant thin film is determined by using an analyzer Quantera SXM, product of ULVAC-PHI, INC., under the condition of an X-Ray output of Al (monochromic) 100 μm square, 15 W, 25 kV, and ion etching is carried out under the condition of Ar (500 V) 2 mm square. The sputter rate is a value of the thin film formed on silicon wafer by coating.

The thickness A can be controlled by adjusting the rubbing depth of the cleaning roller 75A described below used as the cleaning unit 75, the contact pressure of the cleaning blade 75B described below used as the cleaning unit 75, or the absolute value of the difference in relative peripheral velocity of the cleaning roller 75A to the photosensitive member 1 during image-forming. The rubbing depth of the cleaning roller 75A is the approaching distance of the cleaning roller 75A toward the photosensitive member axis, as compared to the position at which the cleaning roller 75A is installed so that it is tangent to the photosensitive member surface. The difference in relative peripheral velocity of cleaning roller 75A to the photosensitive member 1 is a relative difference in velocity, as compared to the peripheral velocity of the photosensitive member, and it is a difference in velocity calculated by subtracting the peripheral velocity of the photosensitive member from the peripheral velocity of the cleaning roller 75A. As for the peripheral velocities of the photosensitive member and the cleaning roller, the rotation direction of the photosensitive member in the contact area between the photosensitive member and the cleaning roller is expressed by a positive value, and the opposite direction to the rotation direction of the photosensitive member is expressed by a negative value. For example, because the photosensitive member 1 and the cleaning roller 75A rotate during image-forming respectively in the directions shown in FIG. 1, if the peripheral velocity of the photosensitive member 1 is 310 mm/sec and the peripheral velocity of the cleaning roller 75A is 217 mm/sec, relative difference in velocity of the cleaning roller 75A to the photosensitive member 1 is represented by "−217−310=−527", and the absolute value is 527 mm/sec.

For example, if the rubbing depth of the cleaning roller 75A or the contact pressure of the cleaning blade 75B is increased, the thickness A becomes smaller. If the rubbing depth of the cleaning roller 75A or the contact pressure of the cleaning blade 75B is decreased, the thickness A becomes larger.

Alternatively, for example, if the absolute value of the difference in relative peripheral velocity of the cleaning roller 75A to the photosensitive member 1 during image-forming is increased, the thickness A becomes smaller. Decrease of the absolute value of the difference in peripheral velocity leads to increase in thickness A.

The difference B−A can be controlled by adjusting the pressing pressure by the pressing unit 73, the contact pressure of the flattening unit 74, the rubbing depth of the cleaning roller 75A, the contact pressure of the cleaning blade 75B, or the absolute value of the difference in relative peripheral velocity of the cleaning roller 75A to the photosensitive member 1 during image-forming. The change in thickness B by adjustment of the contact pressure of the flattening unit 74 is small, and thus, the contact pressure of the flattening unit 74 is preferably used in fine adjustment of the difference B−A.

For example, increase of the pressing pressure of the pressing unit results in increase in thickness B and also increase in B−A. Decrease of the pressing pressure of the pressing unit results in decrease in thickness B and thus decrease in B−A.

Alternatively, for example, increase of the contact pressure of the flattening unit results in decrease in thickness B and also decrease in B−A. Decrease of the contact pressure of the flattening unit results in increase in thickness B and also increase in B−A.

Alternatively, for example, increase of the rubbing depth of the cleaning roller 75A or the contact pressure of the cleaning blade 75B results in decrease in thickness A and increase in B−A. Decrease in the rubbing depth of the cleaning roller 75A or the contact pressure of the cleaning blade 75B results in increase in thickness A and decrease in B−A.

Alternatively, for example, increase of the absolute value of the difference in relative peripheral velocity of the cleaning roller 75A to the photosensitive member 1 during image-forming results in decrease in thickness A and increase in B−A. Decrease of the absolute value of the difference in peripheral velocity results in increase in thickness A and decrease in B−A.

Solid Lubricant

The solid lubricant 71, when present on the photosensitive member surface as a thin film, improves the toner-releasing characteristics of the photosensitive member surface and prevents degradation of the photosensitive layer by $O_3$ and $NO_x$. Examples of the substances constituting the solid lubricant include conventional solid lubricants used for providing a photosensitive member with toner-releasing characteristics or resistance against degradation by $O_3$ or $NO_x$, and typical examples thereof include fatty acid compounds, the metal salts thereof and the like. Only a kind of the compound may be used, or two or more of the compounds may be used in combination. Typical examples of the fatty acid compounds include stearic acid, heptadecanoic acid, palmitic acid, pentadecanoic acid, myristic acid, tridecyl acid, lauric acid, behenic acid, melissic acid, arachic acid, margaric acid (n-heptadecanoic acid), arachidic acid, crotonic acid, oleic acid, elaidic acid, nervonic acid and the like. Examples of the metals that can constitute the metals of the fatty acid metal salt compounds normally include zinc, barium, calcium, magnesium, sodium, potassium, aluminum, lithium, beryllium, silver, iron, copper and the like. Favorable solid lubricants are, for example, zinc stearate, calcium stearate, lithium stearate, magnesium stearate, zinc laurate and the like.

The solid lubricant 71 is prepared by melting a fatty acid compound or the metal salt thereof, pouring the molten compound into a mold and cooling the compound. The shape of the solid lubricant is normally rectangular.

The solid lubricant 71 is normally used, as it is bonded, for example, to a lubricant-holding member 711 of metal plate with a double-faced tape or the like.

Supply Roller

The supply roller 72 is a roller installed as it is in contact with the solid lubricant 71 and the photosensitive member 1. The supply roller 72 scrapes off the solid lubricant 71 and supplies the scraped solid lubricant onto the surface of the photosensitive member 1 by self rotation. The supply roller 72 may be in any shape, as long as it has a roller shape, and may be, for example, a brush roller or a foam roller. Use of a loop brush roller is preferable, from the viewpoint of stability of the amount of the solid lubricant scraped off. When a foam roller is used, it is preferably an unicellular polyurethane foam having a cell number of 20 to 300 per 25 mm and a foam hardness, as determined according to JIS K6400, of 40 to 430N.

The brush roller is a roller having a brushing region at least on the surface, and normally, it is a roller having a brushing region 722 on the peripheral surface of an axial shaft 721, as shown in FIGS. 1 and 2. There may be as needed an additional layer, for example, a base fabric layer, between the axial shaft and the brushing region.

The axial shaft 721 of the brush roller is not particularly limited, as long as it can support the brushing region 722 thereon, and, for example, a cylindrical member of a metal such as iron, aluminum or stainless steel or a non metal material such as a resin may be used.

The brushing region has raised bristles normally planted on a base fabric. The raised bristle contains a conductive substance dispersed in a resin, and may have a straight shape or a looped shape. The brushing region of the brush roller used as the supply roller 72 preferably has a looped shape, from the viewpoint of the efficiency of supplying the solid lubricant. Examples of the resins for the raised bristles include synthetic resins such as polyesters, rayons and acrylics. The conductive substance is, for example, carbon black.

The diameter, the electric resistance and brush-filling density of the raised bristle are not particularly limited, as long as the object of the present invention is achieved, but normally, the diameter is 1 d to 11 d, in particular 2 d to 8 d; the electric resistance is $1\times10^5$ to $1\times10^{13}\Omega$, in particular $1\times10^{11}$ to $1\times10^{12}\Omega$; and the brush-filling density is 70 to 240 kF/inch$^2$, in particular 70 to 120 kF/inch$^2$.

The electric resistance of the raised bristle for use is determined by the following method: A sample of raised bristle having a length of 0.6 mm is cut off from a brush and fixed with holders respectively at points of 0.2 mm and 0.5 mm from the terminal. Voltage (5 V/mm) is applied to the raised bristle between the holders, and the resistivity R thereof is determined by using a digital ultrahigh ohmmeter. The contact resistivity R' is calculated from R and L and the resistivity is calculated from the cross sectional area S of the raised bristle.

The thickness of the brushing region (length of raised bristle) is preferably 1.0 to 3.0 mm, particularly preferably 2.0 to 2.5 mm, in the state where the photosensitive member 1 and the solid lubricant 71 are not in contact with each other.

The foam roller is a roller having a foam layer at least on the surface, and normally has a foam layer 722 on the peripheral surface of the axial shaft 721, as shown in FIGS. 1 and 2. There may be as needed another layer, for example, an adhesive layer, between the axial shaft and the foam layer.

The axial shaft 721 of the foam roller is the same as that for the brush roller.

The foam layer is an elastic layer containing cells (bubbles) dispersed therein, and it is also a so-called closed-cell foam. A rubber is used as the material for the foam layer. Examples of the rubbers include polyurethane rubbers, acrylonitrile-butadiene rubbers, ethylene-propylene rubbers, ethylene-propylene-diene copolymer rubbers, hydrogenated acrylonitrile-butadiene copolymer rubbers, natural rubbers, butadiene rubbers, butyl rubbers, halogenated butyl rubbers, chloroprene rubbers, chlorosulfonated polyethylene rubbers, epichlorohydrin-ethyleneoxide copolymer rubbers, epichlorohydrin homopolymer rubbers, hydrogenated nitrile rubbers, chlorinated polyethylenes, mixed silicone-ethylene propylene rubbers, silicone rubbers, fluorine rubbers and the like. Preferable are polyurethane rubbers, silicone rubbers and fluorine rubbers. These rubbers may be used alone or in combination of two or more.

The foam layer is normally a conductive layer containing a conductive substance dispersed therein. The conductive substance for use is a conductive substance similar to that used in the raised bristle of the brush roller, as it is dispersed.

The electric resistance of the foam layer is not particularly limited, as long as the object of the present invention is achieved, but normally, it is $10^6$ to $10^{12}\Omega$, particularly $10^8$ to $10^{10}\Omega$.

The electric resistance of the foam layer is a value determined by the following method: A roller for measurement is placed on a copper plate, which serves as an electrode, and the electric current observed when total load of 2 kg is applied to the terminals of the shaft and a DC voltage of 100 V is applied between the shaft and the copper plate is determined. The resistivity is calculated by the following Formula:

$$\text{Resistivity } (\Omega)=100\ (V)/\text{Electric current } (A).$$

The thickness of the foam layer is preferably 2 to 6 mm, particularly preferably 3 to 5 mm, in the state where the photosensitive member 1 and the solid lubricant 71 are not in contact with each other.

In FIGS. 1 and 2, the supply roller 72 rotates in the same direction as that of the photosensitive member 1 (forward direction) in the contact area with the photosensitive member 1, but the rotation direction is not limited thereto, and it may rotate in the direction opposite to that of the photosensitive member 1 (counter direction). From the viewpoint of stability of lubricant supply, the supply roller 72 preferably rotates in the same direction as that of the photosensitive member 1 in the contact area with the photosensitive member 1.

The peripheral velocity Vs (m/sec) of the supply roller 72 is normally, preferably 0.5 Vp to 0.9 Vp, particularly preferably 0.6 Vp to 0.8 Vp, with respect to the peripheral velocity Vp (m/sec) of the photosensitive member.

The rubbing depth of the supply roller 72 into the photosensitive member 1 is normally, preferably 0.3 to 1.0 mm, particularly preferably 0.5 to 0.8 mm. The rubbing depth of the supply roller 72 is the approaching distance thereof in the direction toward the photosensitive member axis, relative to the position where the supply roller 72 is installed so that it is tangent to the surface of the photosensitive member.

For prevention of toner contamination, a DC voltage having an absolute value of 100 to 300 V and having the same polarity as the charge polarity of the toner in the developing device 4 is normally, preferably applied to the supply roller 72. In particular, when preliminary charging unit 76 described below is used, because the residual toner is adjusted to a charge polarity different from that of the toner in the developing device 4 by the preliminary charging unit, a DC voltage having an absolute value in the range above and having the same polarity as the charge polarity of the toner in the developing device 4 is preferably applied thereto.

The charge polarity of the toner in the developing device 4, which is the charge polarity of the toner forming a toner thin layer on the development roller 41 of the developing device 4, can be detected by analyzing the toner constituting the toner thin layer by a known method of measuring charging amount such as blow-off method.

Pressing Unit

The pressing unit 73 is not particularly limited, as long as it can press the solid lubricant 71 to the supply roller 72, and normally, a spring, a foam member or the like is used. The pressing unit 73 is normally, fixed to an immobile wall such as housing, for movement of the solid lubricant in the direction toward the foam roller 72 with consumption of the solid lubricant.

The pressing pressure of the pressing unit 73 may be normally 0.3 to 7 N/m.

The pressing pressure of the pressing unit used in the present specification is a value determined by the following method: The force applied by the pressing unit 73 in the direction toward the opposite side of the solid lubricant 71, when the solid lubricant 71 is pressed by the pressing unit 73 to the supply roller 72, was determined by using a push pull gauge.

Flattening Unit

The flattening unit 74 is installed in contact with the photosensitive member at a position downstream of the supply roller 72, specifically downstream of the supply roller 72 and upstream of the charging unit 2, in the rotation direction of the photosensitive member and forms a thin film of the supplied solid lubricant on the photosensitive member surface. Thus, the solid lubricant supplied by the supply roller 72 onto the photosensitive member surface is flattened in the contact area (abrasion area) between the photosensitive member 1 surface and the flattening unit 74, giving a film on the photosensitive member surface.

The contact pressure of the flattening unit 74 to the photosensitive member 1 is normally, 10 to 40 N/m, particularly favorably 15 to 30 N/m.

The contact pressure of the flattening unit 74 to the photosensitive member 1 used in the present specification is a value determined by the following method:

The contact pressure of the flattening member to a pressurization member prepared in the same shape as that of the photosensitive member 1 is determined with a deformation gauge placed on the pressurization member.

A non-foam sheet of rubber material is used as the flattening unit 74 and the sheet is installed with its one terminal in contact with the photosensitive member, as shown in FIGS. 1 and 2. In FIGS. 1 and 2, the flattening unit 74 is installed in the direction along the photosensitive member rotation direction Dp (forward direction), but the installed direction is not limited thereto, and it may be installed, for example, in the direction opposite to the photosensitive member rotation direction Dp (counter direction).

The rubber material for the flattening unit 74 is, for example, a rubber material similar to that for the foam layer of the foam roller of the supply roller 72. Examples of favorable rubber materials for the flattening unit include polyurethane rubbers, silicone rubbers and fluorine rubbers. The thickness of the flattening unit is normally 1.5 to 3 mm.

Cleaning Unit

The cleaning unit 75 is a cleaning roller 75A or a cleaning blade 75B.

As shown in FIG. 1, the cleaning roller 75A removes the residual toner on the photosensitive member surface and scrapes off and recovers the solid lubricant thin film on the photosensitive member surface by self rotation.

As shown in FIG. 2, the cleaning blade 75B removes the residual toner on the photosensitive member surface and recovers the solid lubricant thin film on the photosensitive member surface in contact with the photosensitive member surface.

The cleaning unit 75 is installed in contact with the photosensitive member 1 at a position upstream of the supply roller 72, specifically in contact with the photosensitive member 1 at a position upstream of the supply roller 72 and downstream of the transfer unit 5 in the photosensitive member rotation direction Dp.

Cleaning Roller

The cleaning roller 75A has a roller shape, and may be, for example, a brush roller or a foam roller. For reductions of the driving torque of the cleaning roller and the abrasion loss of the photosensitive member, it is preferably a brush roller. The cleaning roller 75A is a concept including brush roller and foam roller.

The brush roller used as the cleaning roller 75A has a brushing region at least on the surface and normally has a brushing region 752 on the peripheral surface of an axial shaft 751, as shown in FIG. 1. There may be as needed another layer, for example, a base fabric layer, between the axial shaft and the brushing region.

A brush roller similar to the brush roller exemplified as the supply roller 72 can be used as the brush roller of cleaning roller 75A, and it may be the same as or different from the brush roller actually used as the supply roller 72.

The brush roller favorable as the cleaning roller 75A has bristles having a straight shape in the brushing region.

The foam roller used as the cleaning roller 75A has a foam layer at least on the surface and normally has a foam layer 752 on the peripheral surface of the axial shaft 751, as shown in FIG. 1. There may be as needed another layer, for example, an adhesive layer, formed between the axial shaft and the foam layer.

The foam roller for use as a cleaning roller 75A is a foam roller similar to that exemplified as the supply roller 72, and it may be the same as or different from the foam roller actually used as the supply roller 72.

In FIG. 1, the cleaning roller 75A rotates in the direction opposite to that of the photosensitive member 1 (counter direction) in the contacting area with the photosensitive member 1, but the rotation direction is not limited thereto, and it may rotate in the same direction as that of the photosensitive member 1 (forward direction). Because of the function of scraping the lubricant off, the cleaning roller 75A preferably rotates in the direction opposite to that of the photosensitive member 1 in the contacting area with the photosensitive member 1.

The absolute value of the relative difference in velocity of the cleaning roller 75A to the photosensitive member may be, for example, 500 to 800 mm/sec.

The rubbing depth of the cleaning roller 75A into the photosensitive member 1 is normally 0.3 to 2.0 mm, particularly preferably 0.5 to 1.5 mm.

For acceleration of cleaning of the residual toner, normally, a DC voltage having an absolute value of 100 to 500 V, especially 200 to 400 V and having the same polarity as the charge polarity of the toner in the developing device is preferably applied to the cleaning roller 75A. The charge polarity of the toner in the developing device is the charge polarity of the toner forming a toner thin layer on the development roller 41 of the developing device 4, and can be detected by analyzing the toner constituting the toner thin layer by a known method of determining charging amount such as blow-off method. The toner is normally charged by the transfer unit 5 to a charge polarity different from that of the toner in the developing device, and because the residual toner has such a charge polarity, the residual toner is removed electrostatically by the cleaning roller, when the DC voltage is applied to the cleaning roller. Additional application of an AC voltage at an amplitude of 200 to 500 V, particularly 300 to 470 V, and a frequency of 70 to 130 Hz, particularly 90 to 115 Hz to the cleaning roller 75A, is preferable for further acceleration of removal of the residual toner.

From the viewpoint of preventing deposition of the toner on the cleaning roller 75A in order to sufficiently scrape off and recover the solid lubricant thin film on the photosensitive member surface by the cleaning roller, the surface of the cleaning roller 75A is preferably scrubbed with a flicker unit 753. In particular when the cleaning roller is a brush roller, it is preferable to install the flicker unit, because the toner deposits on the brush roller without the flicker unit, inhibiting sufficient scrape off and recovery of the solid lubricant thin film and consequently unsatisfying the relational formulae above.

The flicker unit 753 is normally a metal thin plate. Examples of the metals for use in preparation of the flicker unit include iron, stainless steel and the like. The thickness of the metal thin plate as the flicker unit is normally 1.0 to 3.0 mm, particularly preferably 1.5 to 2.0 mm.

Preferably when flicker unit 753 is installed and the DC voltage is applied to the cleaning roller 75A, a DC voltage having the same polarity as the charge polarity of the toner in the developing device and having an absolute voltage value larger than that applied to the cleaning roller, for example, a voltage of −100 to −500 V, particularly a voltage of −300 to −500 V is preferably applied to the flicker unit. In this way, the toner deposited on the cleaning roller is removed effectively by the flicker unit.

Cleaning Blade

The cleaning blade 75B is a plate-shaped member having an elastic layer made of an elastic material at least in the contacting region with the photosensitive member 1. Typical examples of the cleaning blades 75B include a plate-shaped member only of an elastic layer of elastic material, or a plate-shaped member having an elastic layer of elastic material formed on a metal substrate, and the like.

As shown in FIG. 2, the cleaning blade 75B is installed in contact with the photosensitive member at one terminal. In particular when the cleaning blade 75B is a plate-shaped member having an elastic layer formed on a metal substrate, the plate-shaped member is installed so that the elastic layer contacts with the photosensitive member surface.

Figure 3:
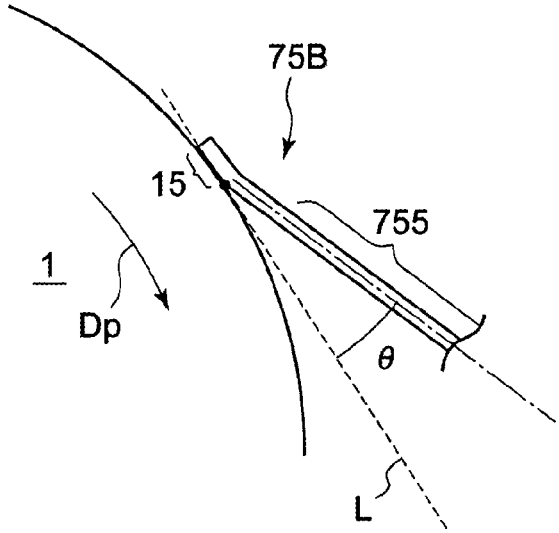
FIG. 3 is an expanded schematic view explaining the angle θ between the cleaning blade used as cleaning unit and the tangent line of the peripheral surface of the photosensitive member in contact with the blade.

In FIG. 2, the cleaning blade 75B is installed at a position toward the direction opposite to the photosensitive member rotation direction Dp (counter direction), but the installed direction is not limited thereto, and it may be installed in the direction along the photosensitive member rotation direction Dp (forward direction). Even when the cleaning blade 75B is installed in any direction, the angle θ between the cleaning blade 75B and the tangent line on the photosensitive member surface in contact with the blade (see FIG. 2) in the cross section perpendicular to the axial direction of the photosensitive member is preferably 10 to 40°, particularly preferably 12 to 15°. In particular when the cleaning blade 75B is installed in the direction opposite to the photosensitive member rotation direction Dp (counter direction), the angle θ is preferably in the range above, for improvement in cleaning efficiency. Specifically as shown in FIG. 3, the angle θ is the angle between the line of the flat plate-shaped region 755 of the cleaning blade 75B, which is undeformed in contact with the photosensitive member 1, and the tangent line L of the photosensitive member surface region 15 in contact with the blade at the position most downstream in the direction Dp in the cross section perpendicular to the axial direction of the photosensitive member 1.

The elastic material constituting the elastic layer of cleaning blade 75B is, for example, a material similar to the rubber material constituting the foam layer of the foam roller of supply roller 72. Favorable rubber materials for the cleaning blade include polyurethane rubbers, silicone rubbers and fluorine rubbers.

The thickness of the elastic layer in the cleaning blade 75B is normally 1.0 to 3.0 mm, in particular 1.5 to 2.0 mm.

The elastic layer normally contains a conductive substance dispersed therein and is thus conductive. Materials similar to the conductive substances dispersed in the raised bristle of the brush roller can be used as the conductive substances.

The electric resistance of the elastic layer is not particularly limited, as long as the object of the present invention is achieved, and it is normally $10^8$ to $10^{13}\Omega$.

The cleaning blade 75B made only of an elastic layer can be prepared by a traditionally known production method. For example, when the cleaning blade 75B is made of a polyurethane rubber, it can be produced by preparing a prepolymer by using a polyurethane elastomer, adding a curing agent and as needed a catalyst and a conductive substance thereto, crosslinking the mixture in a particular mold, post-crosslinking the resin in an oven and aging the resulting resin by leaving it at room temperature. The polyurethane elastomer is normally prepared from a polyol component (such as polyethylene adipate ester or polycaprolactone ester) and a polyisocyanate component (such as 4,4'-diphenylmethane diisocyanate).

A high-molecular weight polyol and a low-molecular weight polyol can be used as the polyol component.

A polyol having two or more hydroxyl groups per molecule and having a number-average molecular weight of 300 to 4000 is used as the high-molecular weight polyol. Typical examples of the high-molecular weight polyols for use include polyester polyols prepared by condensation of an alkylene glycol and an aliphatic dibasic acid; polyester-based polyols including polyester polyols prepared from an alkylene glycol and an adipic acid such as ethylene adipate ester polyols, butylene adipate ester polyols, hexylene adipate ester polyols, ethylene propylene adipate ester polyols, ethylene butylene adipate ester polyols and ethylene neopentylene adipate ester polyol; polycaprolactone-based polyols such as polycaprolactone ester polyols obtained by ring-opening polymerization of a caprolactone; polyether-based polyols such as poly(oxytetramethylene) glycol and poly(oxypropylene) glycol; and the like.

The low-molecular weight polyol for use is a polyol having two or more hydroxyl groups per molecule and having a number-average molecular weight of 150 to 300. Typical examples of the low-molecular weight polyols include bivalent alcohols such as 1,4-butanediol, ethylene glycol, neopentylglycol, hydroquinone-bis(2-hydroxyethyl)ether, 3,3'-dichloro-4,4'-diaminodiphenylmethane and 4,4'-diaminodiphenylmethane; and trivalent or higher polyvalent alcohols such as 1,1,1-trimethylolpropane, glycerol, 1,2,6-hexanetriol, 1,2,4-butane triol, trimethylolethane, 1,1,1-tris (hydroxyethoxymethyl)propane, diglycerin and pentaerythritol.

The polyisocyanate component for use is a polyisocyanate having 2 or more isocyanate groups per molecule. Typical examples of the polyisocyanate components include MDI (4,4'-diphenylmethane diisocyanate) and HDI (1,6-hexane diisocyanate).

The blending rate of the polyols is preferably 60 to 80 wt % in the polyurethane and the blending rate of the polyisocyanates is preferably 30 to 80 parts by weight with respect to 100 parts by weight of the polyurethane.

Compounds traditionally used as curing or crosslinking agents in the field of polyurethane rubber production can be used as the curing agents. Typical examples of the curing agents include triols, short-chain diols and the like.

The content of the curing agent is normally, favorably 0.01 to 1 part by weight with respect to 100 parts by weight of the total of the polyol components and polyisocyanate components.

The cleaning blade 75B having an elastic layer formed on a substrate can be produced by hot melt adhesion onto a substrate of an elastic layer sheet prepared by a method similar to the production method for the above-described cleaning blade 75B having only an elastic layer, except that it is molded into the elastic layer sheet having a particular thickness.

The contact pressure of the cleaning blade 75B to the photosensitive member 1 is normally, preferably 10 to 40 N/m, particularly preferably 20 to 40 N/m.

The contact pressure of the cleaning blade 75B to the photosensitive member 1 used in the present specification is a value obtained by a method similar to that for the contact pressure of the flattening unit to the photosensitive member.

The hardness of the elastic layer of cleaning blade 75B is preferably 60 to 85°, particularly preferably 70 to 80° and the impact resilience thereof is preferably 20 to 50%, particularly preferably 25 to 40%.

The hardness of the elastic layer used is a value obtained according to JIS K6253.

The impact resilience of the elastic layer used is a value obtained according to JIS K6255.

Cleaning Unit (Cleaning Roller/Cleaning Blade)

For effective reduction of the driving force for the cleaning unit 75, an abrasive is preferably supplied to a space between the photosensitive member surface and the cleaning unit 75. The abrasive for use is organic or inorganic fine particles having an average primary particle diameter of 500 to 2000 nm, in particular of 800 to 1000 nm, and typical examples thereof include metal oxides such as silica, alumina and titania; metal carbonate salts such as calcium carbonate; metal phosphate salts such as calcium phosphate; metal sulfides such as molybdenum sulfide; inorganic fluorides such as graphite fluoride; inorganic nitrides such as boron nitride; carbons such as graphite; glass, and the like. These abrasives can be used alone or as a mixture of two or more.

The abrasive can be conveyed onto the photosensitive member surface, as it is simply added externally to the toner and be consequently supplied to the space between the photosensitive member surface and the cleaning unit 75.

Especially when the cleaning unit 75 is a cleaning blade 75B, the abrasive is preferably dispersed in the elastic material at least in the contacting region with the photosensitive member 1 in the cleaning blade 75B. It is possible by using such a cleaning blade to supply the abrasive to the space between the photosensitive member surface and the cleaning unit 75 and consequently reduce the driving force for the cleaning blade effectively. The abrasive can be dispersed in the contacting region with the photosensitive member in the cleaning blade 75B, for example, by a method of adding an abrasive to the raw material mixture and dispersing it therein during production of the cleaning blade. Specifically, the raw material mixture containing the added abrasive is crosslinked in a particular mold, post-crosslinked in an oven and then left for aging, according to the method described above. In an alternative method, after an abrasive is applied to an area of a mold corresponding to the contacting area with the photosensitive member, the raw material mixture may be fed into the mold, and the mixture may be crosslinked, post-crosslinked and left for aging by the method described above. Yet alternatively, after preparation of a cleaning blade, a method of depositing an abrasive in the area corresponding to the contacting area on the cleaning blade surface with the photosensitive member, for example, by an immersion, screen printing, spraying or roll coating method may be used. Use of the method of adding and dispersing an abrasive during production of the cleaning blade or an immersion method is particularly preferable.

The content of the abrasive in the contacting region of the cleaning blade 75B with the photosensitive member 1 is preferably 0.1 to 5 parts by weight, particularly preferably 0.5 to 3 parts by weight, with respect to 100 parts by weight of the elastic material.

For more effective removal of the residual toner on the photosensitive member surface, a preliminary charging unit 76 for electrical discharge to the photosensitive member is preferably installed additionally at an upstream position of the cleaning unit 75 in the photosensitive member rotation direction Dp. Specifically, the preliminary charging unit 76 is installed at a position upstream of the cleaning unit 75 and downstream of the transfer unit 5 in the photosensitive member rotation direction Dp. Because the residual toner is electrically charged by the preliminary charging unit and the charge polarity of the residual toner on the photosensitive member surface is uniformized, the residual toner on the photosensitive member surface can be removed further more effectively.

Normally, a DC voltage having the polarity different from the charge polarity of the toner in the developing device 4 is applied to the transfer unit 5 and the residual toner not transferred is charged to such a polarity, but the charge polarity of the residual toner is not uniform. For that reason, the charge polarity of the residual toner is adjusted to the polarity different from the charge polarity of the toner in the developing device by the preliminary charging unit 76. Normally, a DC voltage having a polarity different from the charge polarity of the toner in the developing device and making an electric current of an absolute value of 400 to 1500 μA, particularly 600 to 1000 μA flow is applied to the preliminary charging unit. Additional application of an AC voltage having an amplitude of 400 to 800 μA, particularly 500 to 700 μA and a frequency of 1 to 3 kHz, particularly 1.8 to 2.4 kHz to the preliminary charging unit is preferable for further acceleration of removal of the residual toner.

Full-Color Image-Forming Apparatus

The image-forming apparatus 10 according to the present invention may be applied to imaging units in full-color image-forming apparatuses. An example of the full-color image-forming apparatus according to the present invention is shown in the schematic configurational view of FIG. 4. Each of the imaging units (10Y, 10M, 10C and 10Bk) in the full-color image-forming apparatus 20 shown in FIG. 4 has the configuration of the image-forming apparatus 10A or 10B shown in FIG. 1 or 2.

Figure 4:
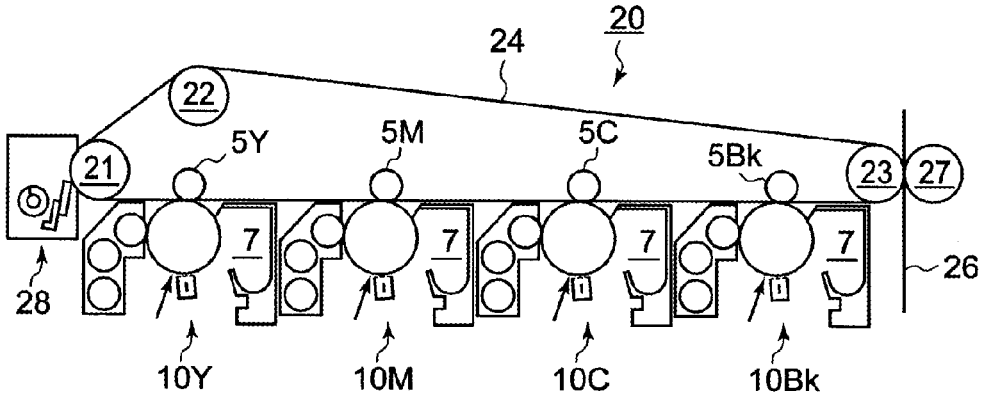
FIG. 4 is schematic configurational view illustrating the entire configuration of an example of the full-color image-forming apparatus according to the present invention.

The full-color image-forming apparatus 20 shown in FIG. 4 has imaging units (10Y, 10M, 10C and 10Bk) for image-forming in each of various colors, an intermediate transfer member 24 tightened by at least two tension rollers (21, 22 and 23 in Figure), primary-transfer rollers (5Y, 5M, 5C and 5Bk) for transfer of the image formed in the imaging unit onto the intermediate transfer member 24, a secondary-transfer roller 27 for transfer of the full-color image transferred and formed on the intermediate transfer member 24 onto a recording medium 26, and a cleaning unit 28 for removing the toner remaining on the intermediate transfer member.

In the full-color image-forming apparatus 20 shown in FIG. 4, the toner image formed in each imaging unit (10Y, 10M, 10C or 10Bk) is primary-transferred onto the intermediate transfer member 24 by a primary transfer roller (5Y, 5M, 5C or 5Bk), and these toner images are superimposed on the intermediate transfer member, giving a full-color image. The full-color image transferred on the surface of the intermediate transfer member 24 is secondary-transferred collectively onto a recording medium 26 such as paper by the secondary transfer roller 27 and the full-color image transferred on the recording medium is made to pass through a fixing unit (not shown in the Figure), giving a full-color image on the recording medium. On the other hand, the residual toner remaining on the intermediate transfer member is removed by the cleaning unit 28.

EXAMPLES

Experimental Example A

A full color printer (bizhub C650; product of Konica Minolta Business Solutions Japan Co., Ltd.) having the configuration shown in FIG. 4 was modified to have imaging units (10Y, 10M, 10C and 10Bk) in the configuration shown below in FIG. 1. Standard equipment of the printer was used, unless specified otherwise.

The (new) photosensitive member 1 shown in FIG. 1 had a laminated organic photosensitive layer having a charge generation layer and a charge transport layer, and additionally a polycarbonate overcoat layer (OCL) having a thickness of about 3 μm formed as the outmost layer. Silica having a particle diameter of 40 nm was dispersed in the overcoat layer. The peripheral velocity Vp of the photosensitive member 1 was 0.31 m/sec.

A Scorotron charger was used as the charging unit 2.

The charge polarity of the toner in the developing device 4 was negative.

The transfer unit 5 was controlled to pass an electric current of 30 μA.

A solid lubricant prepared by melting and molding zinc stearate powder was used as the solid lubricant 71.

The supply roller 72 used was a roller of an iron axial shaft 721 (external diameter: 6 mm) having a base fabric layer (thickness: 0.5 mm) and a brushing region 722 formed on the peripheral surface thereof in that order. The raised bristles in the brushing region were carbon black-containing polyester filaments having a looped shape, and the diameter thereof was 4 deniers, the electric resistance thereof was $1\times10^{12}\Omega$, and the brush-filling density was 70 kF/inch$^2$. The thickness of the brushing region (length of raised bristle) was 2.5 mm, when the brush roller was not in contact with the photosensitive member 1 and the solid lubricant 71. The peripheral velocity Vs of the supply roller 72 was 210 mm/sec. A DC voltage of −300 V was applied to the supply roller 72.

A spring was used as the pressing unit 73.

The flattening unit 74 used was a polyurethane rubber processed into a sheet shape of a thickness of 2 mm.

The cleaning unit 75 used was a nylon bristle brush roller. The cleaning unit 75 had a peripheral velocity of 400 mm/sec, and rotated in the same direction as that of the photosensitive member (so-called counter rotation). A DC voltage of −300 V was applied to the cleaning unit.

The flicker unit 753 used was a stainless steel thin plate. A DC voltage of −500 V was applied to the flicker unit 753.

It did not have preliminary charging unit 76.

Examples/Comparative Examples

Evaluation

Various parameters of the printer described above were set to the particular values shown in Table 1. Subsequently, 1000 sheets of A4 paper were fed into the printer at an ambient temperature of 10° C. and a humidity of 15% without image-forming, and immediately after then, the thicknesses A and B were determined by the method described above. Such operation and measurement were repeated, as the output of the charging unit 2 was changed at three levels. The $O_3$ concentration in the space between the charging unit 2 and the photosensitive member 1 was determined.

Then, after the state was kept as it was for 15 minutes, a half tone image was output and the image noises in the obtained image were evaluated.

In Comparative Example A10, the solid lubricant, the supply roller, the pressing unit and the flattening unit were not used.

Image Noises

○; Completely no generation of image blurring or image flowing;

Δ; Generation of some image blurring or image flowing at a level noticeable when observed carefully (practically causing problems);

x; Generation of image blurring or image flowing at a level easily noticeable (practically causing problems)

TABLE 1

| The Cleaning unit = The Cleaning Roller | | | | | | | | | | | |
|---|---|---|---|---|---|---|---|---|---|---|---|
| | A | B | B-A | Supply Roller Rubbing Depth | Pressing unit Pressing Pressure | Flattening unit Contact Pressure | Cleaning unit Rubbing Depth | Cleaning unit Peripheral Velocity Difference (1) | Image Noises | | |
| | (nm) | (nm) | (nm) | (mm) | (N/m) | (N/m) | (mm) | (m/sec.) | 4 ppm | 16 ppm | 24 ppm |
| Example A1 | 8 | 31 | 23 | 0.5 | 2.0 | 15.0 | 1.5 | 527 | ○ | ○ | ○ |
| Example A2 | 8 | 20 | 12 | 0.5 | 2.0 | 20.0 | 1.5 | 527 | ○ | ○ | ○ |
| Example A3 | 8 | 16 | 8 | 0.5 | 2.0 | 30.0 | 1.5 | 527 | ○ | ○ | ○ |
| Comparative Example A1 | 8 | 2 | 6 | 0.3 | 0.3 | 45.0 | 1.0 | 620 | Δ | x | x |
| Comparative Example A2 | 8 | 4 | 4 | 0.3 | 0.3 | 48.0 | 1.0 | 620 | x | x | x |
| Comparative Example A3 | 8 | 8 | 0 | 0.3 | 0.3 | 50.0 | 1.0 | 620 | x | x | x |
| Example A4 | 8 | 38 | 30 | 0.5 | 3.0 | 15.0 | 1.0 | 620 | ○ | ○ | ○ |
| Example A5 | 8 | 25 | 17 | 0.5 | 3.0 | 20.0 | 1.0 | 620 | ○ | ○ | ○ |
| Example A6 | 8 | 17 | 9 | 0.5 | 2.0 | 30.0 | 1.0 | 620 | ○ | ○ | ○ |
| Example A7 | 4 | 27 | 23 | 0.5 | 2.0 | 20.0 | 1.0 | 775 | ○ | ○ | ○ |
| Example A8 | 4 | 16 | 12 | 0.5 | 2.0 | 30.0 | 1.0 | 775 | ○ | ○ | ○ |
| Example A9 | 4 | 12 | 8 | 0.5 | 1.0 | 30.0 | 1.0 | 775 | ○ | ○ | ○ |
| Comparative Example A4 | 4 | 11 | 7 | 0.5 | 1.0 | 30.0 | 1.0 | 775 | ○ | ○ | Δ |
| Comparative Example A5 | 4 | 8 | 4 | 0.3 | 0.3 | 50.0 | 1.0 | 775 | ○ | Δ | x |
| Comparative Example A6 | 2 | 9 | 7 | 0.3 | 0.3 | 50.0 | 2.0 | 930 | ○ | ○ | Δ |
| Comparative Example A7 | 2 | 6 | 4 | 0.3 | 0.2 | 45.0 | 2.0 | 930 | ○ | Δ | x |
| Comparative Example A8 | 1 | 7 | 6 | 0.3 | 0.2 | 45.0 | 3.0 | 930 | Δ | Δ | x |
| Comparative Example A9 | 1 | 4 | 3 | 0.3 | 0.1 | 45.0 | 3.0 | 930 | Δ | x | x |
| Comparative Example A10 (2) | 0 | 0 | 0 | — | — | — | 1.0 | 620 | x | x | x |

(1) The absolute value of the relative difference in peripheral velocity of the Cleaning unit 75 to the Photosensitive member 1;

(2) The solid lubricant, the supply roller, the pressing unit and the flattening unit were not used.

Experimental Example B

A full color printer (bizhub C650; product of Konica Minolta Business Solutions Japan Co., Ltd.) having the configuration shown in FIG. 4 was modified to have imaging units (10Y, 10M, 10C and 10Bk) in the configurations shown below in FIG. 2. Standard equipment of the printer was used, unless specified otherwise.

The photosensitive member 1, the charging unit 2, the developing device 4, the transfer unit 5, the solid lubricant 71, the supply roller 72, the pressing unit 73 and the flattening unit 74 in FIG. 2 were the same as those in Experimental Example A.

The cleaning unit 75 used was a cleaning blade having an elastic layer prepared from 100 parts by weight of a polyurethane rubber, 0.1 part by weight of silica (average primary particle diameter: 500 nm) and 1 part by weight of carbon black on a metal substrate. The thickness of the elastic layer was 2 mm, the hardness was 75°, and the impact resilience was 40%. The cleaning blade was used, as the elastic layer is in contact with the photosensitive member surface.

It did not have a preliminary charging unit 76.

Examples/Comparative Examples

Evaluation

Evaluation was made by method similar to those in Experimental Example A, except that various parameters of the printer described above were set to the particular values shown in Table 2.

In Comparative Example B1, the solid lubricant, the supply roller, the pressing unit and the flattening unit were not used.

In Comparative Example B2, a printer (bizhub C650; product of Konica Minolta Business Solutions Japan Co., Ltd.) having the configuration shown in FIG. 4 was modified to have imaging units (10Y, 10M, 10C and 10Bk) in the configuration shown below in FIG. 5. Standard equipment of the printer was used, unless specified otherwise.

Figure 5:
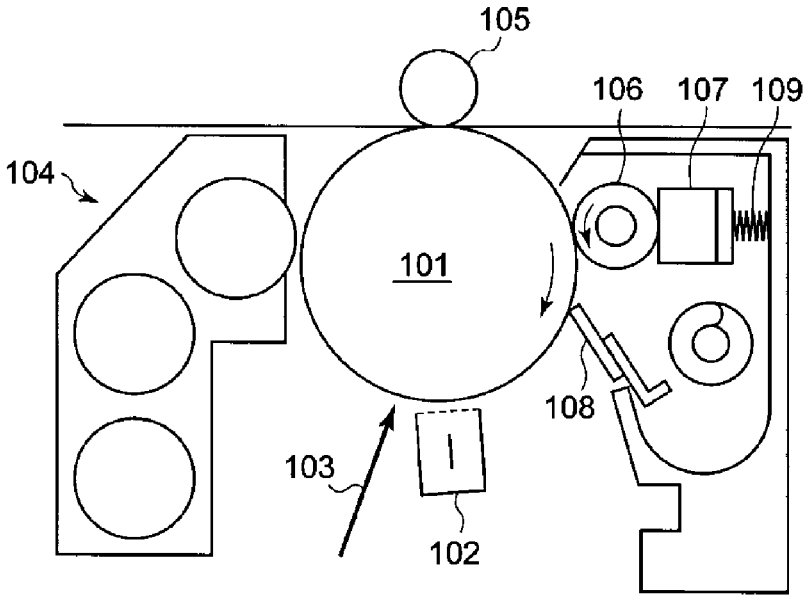
FIG. 5 is a schematic configurational view illustrating an example of conventional image-forming apparatus.

The photosensitive member 101, the charging unit 102, the developing device 104, the transfer unit 105, the solid lubricant 107, the supply roller 106, the pressing unit 109 and the cleaning blade 108 in FIG. 5 were the same respectively as the photosensitive member 1 (unused), the charging unit 2, the developing device 4, the transfer unit 5, the solid lubricant 71, the supply roller 72 and the pressing unit 73 in the Test Example A and the cleaning unit 75 (cleaning blade) in the Experimental Example B.

TABLE 2

The Cleaning unit = The Cleaning Blade

| | A | B | B-A | Supply Roller Rubbing Depth | Pressing unit Pressing Pressure | Flattening unit Contact Pressure | Cleaning unit Contact Pressure | Cleaning unit Angle θ | Image Noises | | |
|---|---|---|---|---|---|---|---|---|---|---|---|
| | (nm) | (nm) | (nm) | (mm) | (N/m) | (N/m) | (N/m) | (°) | 4 ppm | 16 ppm | 24 ppm |
| Example B1 | 10 | 31 | 21 | 0.5 | 2.0 | 15 | 20 | 15 | ○ | ○ | ○ |
| Example B2 | 10 | 21 | 11 | 0.5 | 2.0 | 20 | 20 | 12 | ○ | ○ | ○ |
| Example B3 | 10 | 18 | 8 | 0.5 | 2.0 | 30 | 20 | 15 | ○ | ○ | ○ |
| Example B4 | 8 | 38 | 30 | 0.5 | 3.0 | 15 | 25 | 12 | ○ | ○ | ○ |
| Example B5 | 8 | 25 | 17 | 0.5 | 3.0 | 20 | 25 | 12 | ○ | ○ | ○ |
| Example B6 | 8 | 16 | 8 | 0.5 | 2.0 | 30 | 25 | 12 | ○ | ○ | ○ |
| Example B7 | 6 | 15 | 9 | 0.5 | 2.0 | 30 | 40 | 12 | ○ | ○ | ○ |
| Example B8 | 4 | 27 | 23 | 0.5 | 2.0 | 20 | 40 | 12 | ○ | ○ | ○ |
| Example B9 | 4 | 15 | 11 | 0.5 | 2.0 | 30 | 40 | 12 | ○ | ○ | ○ |
| Example B10 | 4 | 12 | 8 | 0.5 | 1.0 | 30 | 40 | 15 | ○ | ○ | ○ |
| Comparative Example B1 (2) | 0 | 0 | 0 | — | — | — | 30 | 15 | x | x | x |
| Comparative Example B2 (3) | 4 | 10 | 6 | 0.5 | 1.0 | 30 | 40 | 15 | ○ | ○ | Δ |
| Comparative Example B3 | 4 | 8 | 4 | 0.3 | 0.3 | 50 | 40 | 15 | ○ | Δ | x |
| Comparative Example B4 | 4 | 6 | 2 | 0.3 | 0.2 | 45 | 40 | 15 | x | x | x |
| Comparative Example B5 | 2 | 9 | 7 | 0.3 | 0.3 | 50 | 42 | 15 | ○ | ○ | Δ |
| Comparative Example B6 | 2 | 5 | 3 | 0.3 | 0.2 | 45 | 42 | 15 | ○ | Δ | x |
| Comparative Example B7 | 2 | 3 | 1 | 0.3 | 0.1 | 50 | 42 | 15 | ○ | x | x |
| Comparative Example B8 | 1 | 8 | 7 | 0.3 | 0.2 | 45 | 45 | 15 | Δ | Δ | x |
| Comparative Example B9 | 1 | 5 | 4 | 0.3 | 0.1 | 45 | 45 | 15 | Δ | x | x |
| Comparative Example B10 | 1 | 1 | 0 | 0.2 | 0.1 | 50 | 45 | 15 | x | x | x |

(2) The solid lubricant, the supply roller, the pressing unit and the flattening unit were not used.
(3) The Imaging Units had the configuration shown in FIG. 5.

Effect Of The Invention

It is possible to prevent generation of image noises such as image blurring and image flowing in the solid lubricant-coating device according to the present invention sufficiently, even when image-forming is carried out at high speed. It is also possible to elongate the lifetime of the photosensitive member.

What is claimed is:

1. A solid lubricant-coating device, comprising:

a solid lubricant to be applied to the surface of a latent image-supporting member;

a supply roller installed in contact with the solid lubricant and the latent image-supporting member that scrapes off the solid lubricant and supplies the scraped solid lubricant onto the surface of the latent image-supporting member by self rotation;

a pressing unit for pressing the solid lubricant to the supply roller;

a flattening unit installed in contact with the latent image-supporting member at a downstream position of the supply roller in the rotation direction of the latent image-supporting member that forms a thin film of the supplied solid lubricant on the latent image-supporting member surface; and a cleaning unit installed in contact with the latent image-supporting member at an upstream position of the supply roller in the rotation direction of the latent image-supporting member that removes the residual toner on the latent image-supporting member surface and recovers the solid lubricant thin film on the latent image-supporting member surface, wherein when a thickness of the solid lubricant thin film formed on the latent image-supporting member surface immediately before the supply roller in the rotation direction of the latent image-supporting member is designated as thickness A (nm) and a thickness immediately after the flattening unit is designated as thickness B (nm), the thicknesses A and B satisfy the following relational formulae (1) and (2):

$$B-A \geq 8 \quad (1) \text{ and}$$

$$A \geq 4 \quad (2).$$

2. The solid lubricant-coating device according to claim 1, wherein the cleaning unit is a cleaning roller for removing the residual toner and recovering the solid lubricant thin film by self rotation.

3. The solid lubricant-coating device according to claim 2, wherein a DC voltage having the same polarity as the charge polarity of the toner in a developing device is applied to the cleaning roller.

4. The solid lubricant-coating device according to claim 1, wherein the cleaning unit is a cleaning blade for removing the residual toner and recovering the solid lubricant thin film in contact with the latent image-supporting member surface.

5. The solid lubricant-coating device according to claim 4, wherein an abrasive is dispersed in an elastic material at least in the contacting region with the latent image-supporting member in the cleaning blade.

6. The solid lubricant-coating device according to claim 5, wherein a content of the abrasive in the contacting region of the cleaning blade with the latent image-supporting member is 0.1 to 5 parts by weight with respect to 100 parts by weight of the elastic material.

7. The solid lubricant-coating device according to claim 1, further comprising a preliminary charging unit for electrical discharge to the latent image-supporting member at an upstream position of the cleaning unit in the rotation direction of the latent image-supporting member.

8. The solid lubricant-coating device according to claim 7, wherein a DC voltage is applied to the preliminary charging unit.

9. The solid lubricant-coating device according to claim 1, wherein an abrasive is supplied to a space between the latent image-supporting member surface and the cleaning unit.

10. The solid lubricant-coating device according to claim 1, wherein the thicknesses A and B satisfy the following relational formulae (1') and (2'):

$$50 \geq B - A \geq 8 \quad (1') \text{ and}$$

$$30 \geq A \geq 4 \quad (2').$$

11. The solid lubricant-coating device according to claim 1, wherein the thicknesses A and B satisfy the following relational formulae (1") and (2"):

$$30 \geq B - A \geq 8 \quad (1'') \text{ and}$$

$$10 \geq A \geq 4 \quad (2'').$$

12. The solid lubricant-coating device according to claim 1, wherein a DC voltage having the same polarity as the charge polarity of the toner in a developing device is applied to the supply roller.

13. An image-forming apparatus, comprising the solid lubricant-coating device according to claim 1.

14. A method for coating the surface of a latent image-supporting member with a solid lubricant, comprising:

scraping off the solid lubricant and supplying the scraped solid lubricant onto the surface of a latent image-supporting member by self rotation of a supply roller installed in contact with the solid lubricant and the latent image-supporting member;

pressing the solid lubricant to the supply roller by a pressing unit;

forming a thin film of the supplied solid lubricant on the latent image-supporting member surface by a flattening unit installed in contact with the latent image-supporting member at a downstream position of the supply roller in the rotation direction of the latent image-supporting member; and removing the residual toner on the latent image-supporting member surface and recovering the solid lubricant thin film on the latent image-supporting member surface by a cleaning unit installed in contact with the latent image-supporting member at an upstream position of the supply roller in the rotation direction of the latent image-supporting member, wherein when the thickness of the solid lubricant thin film formed on the latent image-supporting member surface immediately before the supply roller in the rotation direction of the latent image-supporting member is designated as thickness A (nm) and the thickness immediately after the flattening unit is designated as thickness B (nm), the thicknesses A and B satisfy the following relational formulae (1) and (2):

$$B - A \geq 8 \quad (1) \text{ and}$$

$$A \geq 4 \quad (2).$$

* * * * *